US006932113B1

(12) United States Patent
Kauss

(10) Patent No.: US 6,932,113 B1
(45) Date of Patent: Aug. 23, 2005

(54) PILOT DEVICE

(75) Inventor: Wolfgang Kauss, Francheville (FR)

(73) Assignee: Mannesmann Rexroth AG, Lohr a.M. (DE)

( * ) Notice: Subject to any disclaimer, the term of this patent is extended or adjusted under 35 U.S.C. 154(b) by 234 days.

(21) Appl. No.: 10/110,466

(22) PCT Filed: Sep. 25, 2000

(86) PCT No.: PCT/DE00/03323

§ 371 (c)(1),
(2), (4) Date: Jul. 24, 2002

(87) PCT Pub. No.: WO01/29428

PCT Pub. Date: Apr. 26, 2001

(30) Foreign Application Priority Data

Oct. 15, 1999 (DE) ..... 199 49 802

(51) Int. Cl.[7] ..... F15B 13/02
(52) U.S. Cl. ..... 137/636.2
(58) Field of Search ..... 137/636.2

(56) References Cited

U.S. PATENT DOCUMENTS 4,445,541 A 5/1984 Schmiel
4,645,030 A 2/1987 von Bernuth et al.
4,755,100 A 7/1988 Schultz et al.
5,620,053 A 4/1997 Kamikawa et al.
5,638,866 A 6/1997 Mueller
5,934,324 A * 8/1999 Bessard ..... 137/636.2

FOREIGN PATENT DOCUMENTS

| | | |
|---|---|---|
| DE | 25 21 542 | 12/1976 |
| DE | 33 10 626 A1 | 10/1984 |
| DE | 296 04 210 U1 | 7/1996 |
| DE | 196 30 798 A1 | 1/1998 |
| DE | 198 27 481 A1 | 12/1998 |
| EP | 0 089 447 A2 | 9/1983 |
| EP | 0 712 062 A2 | 5/1996 |

* cited by examiner

*Primary Examiner*—Gerald A. Michalsky
(74) *Attorney, Agent, or Firm*—Oliff & Berridge, PLC

(57) ABSTRACT

What is disclosed is a pilot apparatus whereby at least two mechanically operable control valves and two electrically or electro-hydraulically operable control valves may be driven. The pilot apparatus comprises a pivoted lever having two handles, on each of which a switching element for driving the electrically/electro-hydraulically operable control valves is provided.

17 Claims, 1 Drawing Sheet

PILOT DEVICE

DESCRIPTION

Figure 1:
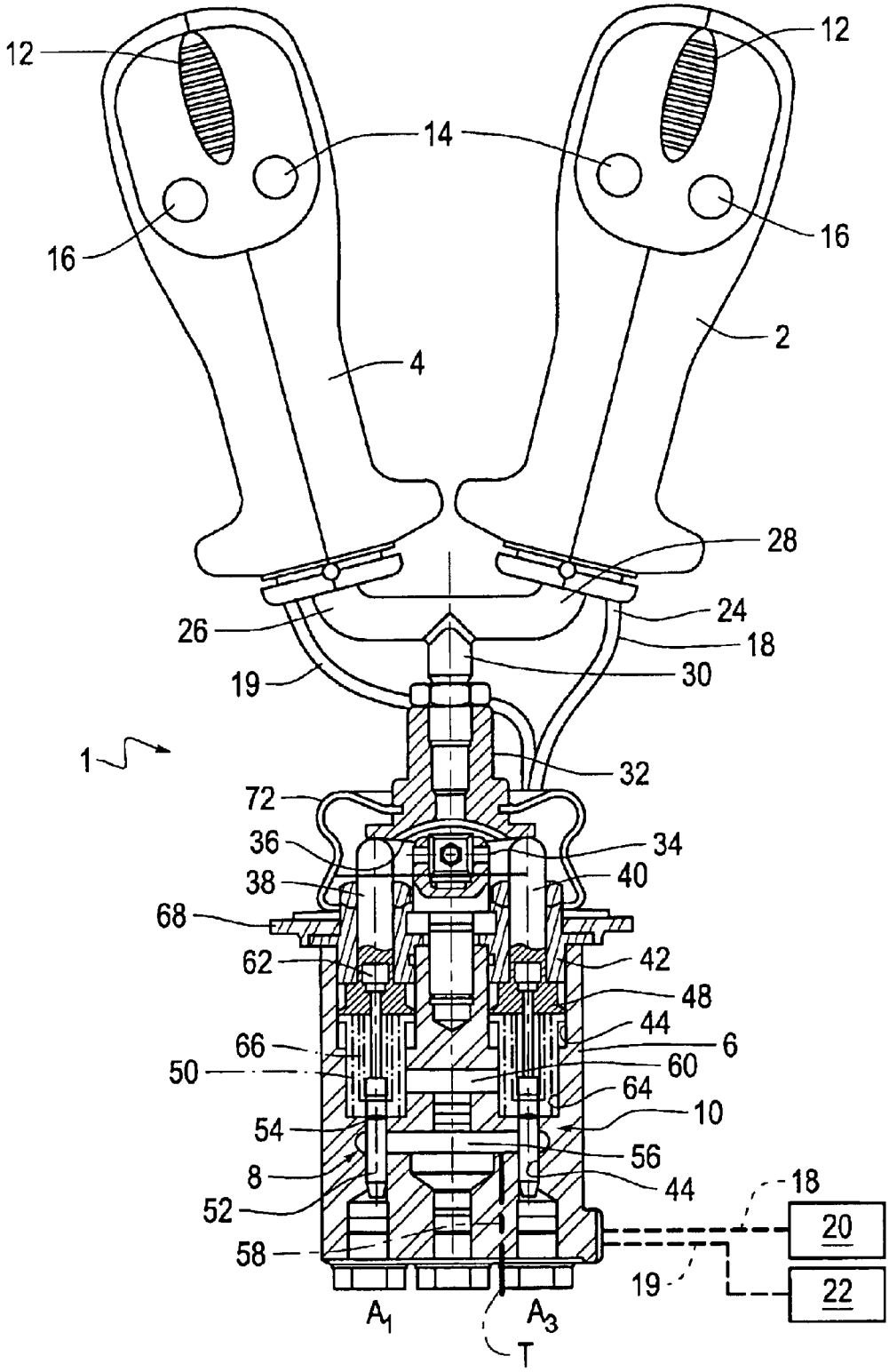

The invention relates to a pilot apparatus whereby at least two mechanically operable and two electrically or electro-hydraulically operable control valves may be driven.

The like pilot apparatuses are in particular used in mobile tools such as in telescopic stackers. Through this pilot apparatus, units of the tool, e.g. a shovel, a fork, a lifting cylinder, brushes, or a work platform are driven.

In German utility model DE 296 04 210 U1, a pilot apparatus is disclosed wherein an actuation panel may be pivoted via a handle (joystick) for mechanically operating actuators of four control valves. By pivoting the handle it is possible to operate one or two of the control valves for driving one of the above mentioned consumers. For two additional control valves one more pivoted lever operatively connected with the handle is provided.

It in one drawback in this variant that considerable expense in mechanical terms is necessary for mechanically connecting the handle and the pivoted lever and mounting them. Simultaneous driving of the control valves operated via the pivoted lever and operated via the handle equally constitutes a problem, for in this case both operating means need to be pivoted concurrently, with single-handed operation consequently not being possible.

In order to eliminate this drawback, a solution is known from DE 196 30 798 wherein a switch is formed on the handle, whereby hydraulically adjustable directional control valves may be driven. To be more precise, through the intermediary of an electric switch a switchover valve is operated which switches between two hydraulically operated directional control valves, so that the consumer connected to the activated directional control valve may be operated by way of the output signal of a pressure reducing valve. Driving the other directional control valve is under the condition of the switchover valve being switched and the pressure reducing valve being activated.

If, for example, a telescopic rod is designed to include a work platform and some other tool such as a fork, then driving the platform and the further tool is effected via the pilot apparatus. I.e., for example in the one switching position of the switch, the platform is released, while in the other switching position the further tool such as the fork is inclined or raised.

In the case of erroneous operation of the switch, in this variant the work platform may be released instead of inclining the fork, so that a hazard to the workers and equipment standing on the platform is not excluded.

In contrast, the invention is based on the objective of providing a pilot apparatus in which the risk of erroneous operation is minimized.

This object is achieved through a pilot apparatus having the features of claim 1.

In accordance with the invention, driving the mechanically operated control valves is performed via a pivoted lever equipped with two handles. Bach one of the handles carries a switching element through which only one associated electrically/electro-hydraulically driven control member each may be driven.

In accordance with the invention, a separate switching element is thus associated to each control member, wherein the switching elements are spaced apart from each other in such a way that an erroneous operation thereof is virtually excluded. The operator accordingly has to consciously grasp one of the handles and operate the switching element formed on it, in order to drive the consumer connected with it. Driving the mechanically operable control valve in accordance with the invention takes place through pivoting the pivoted lever, wherein it is not of importance through which handle the pivoted lever is actuated.

I.e., driving the consumers connected to the mechanically operated control valves is possible via both handles, whereas driving the consumers connected to the electrically/electro-hydraulically operated control members only takes place purposely through grasping the associated handle.

The pilot valve of the invention is characterized by an extremely compact construction, for in order to operate six control valves, for example, only one common pivoted lever with two separate switching elements is necessary.

In accordance with the invention it is preferred for the switching elements for driving the electrically operated control valves to be in the form of potentiometers. Adjustment of the potentiometers may be carried out time-dependent or by adjusting a slide switch.

In a preferred embodiment, the pilot apparatus has the form of four mechanically operated proportional valves which may be operated by pivoting the pivoted lever equipped with two handles.

In a particularly preferred embodiment, each handle may moreover be provided with switches which may be used for driving further units.

Under an ergonomic aspect, the pilot apparatus has a particularly favorable design if the two handles or grasp sections have a V-shaped relative arrangement.

In one embodiment of a handle with potentiometer and two switches, the operating element for the potentiometer is preferably formed in the center plane of the handle, while the two switches are arranged on either side of the center plane of the handle.

The pilot apparatus according to the invention may be employed to particular advantage in telescopic stackers (tele-handlers:).

Other advantageous developments of the invention are the subject matters of the further subclaims.

In the following a preferred embodiment of the invention will be explained in more detail by way of one schematic drawing. The only figure shows a sectional view of a pilot apparatus in accordance with the invention.

The pilot apparatus 1 represented in the figure comprises handles 2, 4 pivotally mounted in a housing block 6 and operable via the four pressure reducing valves (DRV). In the sectional view in accordance with the figure, only the pressure reducing valves 8, 10 are represented; the two other pressure reducing valves are situated on the same partial circle above and underneath the plane of the drawing, respectively.

Via the four pressure reducing valves 8, 10 it is possible to control units of a mobile tool, e.g., a boom or a fork of a telescopic stacker.

Each handle 2, 4 carries on its front side facing the operator a switch 12 for operating a potentiometer and two switching keys 14, 16 for operating switching elements. With the aid of the switch 12 of the potentiometer and the control lines 18 and 19 connected thereto, respectively, a respective signal may be output to an electrically or electro-hydraulically operable pilot valve 20, 22 which are indicated schematically only in the figure.

Via the switching keys 14, 16 further units of the tool may be switched on or off or locked.

The two handles 2, 4 are fixedly connected with each other through a coupling member 24. This coupling member 24 comprises two fork-type legs 26, 28 on which the handle 2 or 4, respectively, is fastened. The two legs 26, 28 merge in a journal 30 screwed into a bush of a articulated joint 32. The latter comprises a pivotal joint 34 having the form of a universal joint or the like, which admits pivoting of the handles 2, 4 so that one or both of the pressure reducing valves 8, 10 are operable. I.e., the two handles 2, 4 may be pivoted out of the plane of the drawing virtually in any desired direction.

In the embodiment represented in the figure, the two handles 2, 4 are arranged so an to merge in a V-shape in a direction toward the coupling member 24. Owing to this relative arrangement of the two handles 2, 4, grasping a handle for operating one of the two pilot valves 20, 22 may take place very swiftly. In particularly critical applications, the V-shaped relative arrangement also permits two-handed operation, so that both pilot valves 20, 22 may be driven at the same time.

The two handles 2, 4 may fundamentally also have the form of sections on a closed operating member which is designed, e.g., with a continuous gripping ring similar to a steering wheel etc.

The articulated joint 32 has on an annular shoulder removed from the handles 2, 4 a control surface 36 against which the four actuators 38, 40 for operating the four directly operated pressure reducing valves 8, 10 (two of the actuators are not represented) are biased. The actuators 38, 40 are each guided in guide bushes 42 each inserted into a respective valve bore 44 of the housing block 6.

Via each one of the pressure reducing valves 8, 10 a central pressure port P of the housing block 6 may be connected with one work port A1, A3 each (the two further work ports A2, A4 which are not represented are located above and below, respectively, of the plane of the drawing) or with a tank port T.

The housing block 6 is closed by means of a housing lid 68 on which a bellows 72 is fastened so as to encompass the actuators 38, 40 and prevent the penetration of dirt.

The construction of the used pressure reducing valves 8, 10 is known per se, so that the following description is restricted to the essential components only.

The valve bore 44 of each pressure reducing valve 8, 10 comprises a radially expanded portion which forms a spring chamber 46. At the peripheral walls of the spring chamber 46 a support bush 48 is guided, which is biased through a return spring 50 against the associated actuator 38 or 40 and in the direction of a stop position against the associated guide bush 42. The return springs 50 apply a force on the actuators 38, 40 in the direction of their position of contact with the control surface 36. The return spring 50 is supported on the annular surface of the spring chamber 46 removed from the guide bush 42.

Each pressure reducing valve 8, 10 comprises a control piston 52 guided in the radially set-back portion of the valve bore 44. Each control piston 52 includes a transversal bore 54 connected through an axial bore, not represented here, with the pressure chamber adjacent the lower (view of the figure) end face of the control piston 52.

The pressure port P and the tank port T are connected through a pressure passage 56 with the valve bores 44, and through a tank passage 58, 60 indicated in dash-dotted lines with the spring chambers 46 of the four pressure reducing valves 8, 10.

The control piston 52 extends through the spring chamber 46 and the support bush 48 guided therein, with a stop screw 62 being fastened to the support bush-side end portion at the control piston 52. As is evident from the representation, each actuator 38, 40 includes an axial recess into which the end portion of the control piston 52 having the stop screw 62 may plunge.

The end portion of each control piston 54 that is received in the spring chamber 46 carries a spring plate 64 an which a control spring 66 supported on the neighboring end face of the support bush 48 attacks. Via this control spring 66 the control piston 52 is biased into its represented position relative to the support bush 48, with this position being determined by the stop screw 62 moving into contact with the neighboring end face of the support bush 48. The return spring So take: the control piston 52 via the support bush 48 into the represented basic position in which the connection between the pressure port P and the associated work port A is blocked.

By pivoting one of the handles from the represented basic position into a pivoted, position, one or two actuators of the four pressure reducing valves 8, 10 are axially displaced in a downward direction, while the remaining actuators of the two or three other pressure reducing valves remain in their basic positions. Owing to the axial displacement of one actuator, the associated support bush 48 is displaced against the force of the return spring 50 in a downward direction in accordance with the representation, so that a corresponding change of the bias of the control spring 46 which is also supported against the support bush 48 takes place. Due to the increased bias of the control spring 66, the control piston 52 is moved out of the represented basic position, so that the connection between the pressure passage P and the associated work port A in controlled open via the transversal bore 54 and the axial bore which is not represented. This pressure at work port A applies a force counteracting the spring force of the control spring 66 to the bottom end face of the control piston 52. The bias of the control spring 66 may be modified by changing the pivotal position of the handles 2, 4. If the pressure force acting on the end face at work port A exceeds the set spring force of the control spring 66, the control piston 52 is moved into a control position in which a pressure equivalent to the force of the control spring 66 is maintained through connecting the work port A with the tank port T or the pressure port P in the work port A. I.e., the pressure at the work port A is maintained constant as a function of the pivotal position of the handles 2, 4.

In accordance with the invention it is not important through which one of handles 2, 4 pivoting of the articulated joint 32 and thus control of the pressure reducing valves 8, 10 is effected.

Driving the electrically/electro-hydraulically operable pilot valves 20, 22 is carried out through operating the switches 12 of handle 2 or handle 4, respectively. These switches 12 may, e.g., have the form of slide members, with potentiometer adjustment taking place through slide member adjustment, or as key buttons, with potentiometer adjustment taking place as a function of the duration of key button actuation, or as control knobs.

In a case where the operator wishes to operate the pilot valve 22, for example the right handle 2 in the figure is grasped and the switch 12 is operated, so that via the associated signal line 18 a control signal is output to the pilot valve 20, 22, and the consumer connected thereto is driven. For driving the other pilot valve 22, the left handle 4 in the figure must be grasped and operated correspondingly.

Thanks to this separation of the switching elements for driving the pilot valves 20, 22, erroneous operation is virtually excluded. The four pressure reducing valves 8, 10 may be operated through both handles 2, 4, whereby operation is facilitated substantially.

What is disclosed is a pilot apparatus whereby at least two mechanically operable control valves and two electrically or electro-hydraulically operable control valves may be driven. The pilot apparatus comprises a pivoted lever having two handles, on each of which a respective switching element for driving the electrically/electro-hydraulically operable control valves is provided.

What is claimed is:

1. A pilot apparatus, comprising:

at least one mechanically operable control valve operable via a pivoted lever, and having a switching element for electrically driving at least two further, electrically/electro-hydraulically operable pilot valves, the pivoted lever comprises two handles each associated to at least one electrically operable pilot valve, the handles each carrying a switching element for operating one of the electrically operable pilot valves.

2. A pilot apparatus according to claim 1, the switching element comprises a potentiometer for proportionally driving the pilot valves.

3. A pilot apparatus according to claim 2, the two handles have a V-shaped relative arrangement, and that an actuating key for the potentiometer is in the form of a slide member, the sliding axis of which is formed in the center plane of the respective handle so as to form an axis of symmetry for two spaced-apart switching keys.

4. A pilot apparatus according to claim 1, the switching element comprises a potentiometer for proportionally driving said pilot valves, and the potentiometer is operable via a slide key of the handle.

5. A pilot apparatus according to claim 4, the two handles have a V-shaped relative arrangement, and that an actuating key for the potentiometer is in the form of a slide member, the sliding axis of which is formed in the center plane of the respective handle so as to form an axis of symmetry for two spaced-apart switching keys.

6. A pilot apparatus according to claim 1, each handle comprises at least one switch for driving at least one additional valve.

7. A pilot apparatus according to claim 1, the mechanically operated valves are pressure reducing valves.

8. A pilot apparatus according to claim 1, the two handles have a V-shaped relative arrangement.

9. A pilot apparatus according to claim 1, the pilot apparatus is associated to a mobile tool.

10. A pilot apparatus, comprising:

four mechanically, proportionally operable control valves operable via a pivoted lever operable, and having a switching element for electrically driving least two further, electrically/electro-hydraulically operable pilot valves, the pivoted lever comprises two handles each associated to at least one electrically operable pilot valve, the handles each carrying a switching element for operating one of the electrically operable pilot valves, and that one or two of the control valves are jointly operable through pivoting the handles.

11. A pilot apparatus according to claim 10, the switching element includes a potentiometer for proportionally driving the pilot valves.

12. A pilot apparatus according to claim 11, the two handles have a V-shaped relative arrangement and that an actuating key for the potentiometer is in the form of a slide member, the sliding axis of which is formed in the center plane of the respective handle so as to form an axis of symmetry for two spaced-apart switching keys.

13. A pilot apparatus according to claim 10, the switching element includes a potentiometer for proportionally driving the pilot valves, and that the potentiometer is operable via a slide key of the handle.

14. A pilot apparatus according to claim 10, each handle comprises at least one switch for driving at least one additional valve.

15. A pilot apparatus according to claims 10, the mechanically operated valves are pressure reducing valves.

16. A pilot apparatus according to claim 10, the two handles have a V-shaped relative arrangement.

17. A pilot apparatus according to claim 10, the pilot apparatus is associated to a mobile tool.

* * * * *